US006291786B1

(12) United States Patent
Gericke et al.

(10) Patent No.: US 6,291,786 B1
(45) Date of Patent: Sep. 18, 2001

(54) HIGH-VOLTAGE CIRCUIT BREAKER HAVING AN INTERRUPTER MODULE

(75) Inventors: Joachim Gericke; Andrzej Nowakowski; Klaus Schuler, all of Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/451,734

(22) Filed: Nov. 30, 1999

(30) Foreign Application Priority Data

Nov. 30, 1998 (DE) ..... 198 56 775

(51) Int. Cl.[7] ..... H01B 17/00; H01H 33/02

(52) U.S. Cl. ..... 218/152; 218/155; 174/18; 174/142

(58) Field of Search ..... 174/18, 139, 142, 174/144, 152 R; 218/152, 155, 1, 43–89; 361/600–835

(56) References Cited

U.S. PATENT DOCUMENTS

| | | | | |
|---|---|---|---|---|
| 5,466,891 | * | 11/1995 | Freeman et al. | 174/142 |
| 5,478,980 | | 12/1995 | Freeman et al. | 218/59 |
| 5,569,891 | * | 10/1996 | Freeman et al. | 218/155 X |
| 5,600,112 | * | 2/1997 | Opfer | 218/155 X |

* cited by examiner

*Primary Examiner*—J. R. Scott
(74) *Attorney, Agent, or Firm*—Kenyon & Kenyon

(57) ABSTRACT

A high-voltage circuit breaker that has a grounded enclosure and an interrupter module arranged in the grounded enclosure. The interrupter module has short pipe connections and bushings mounted on them to accommodate connecting leads. The current converters are arranged on the bushings. The insulation body of the bushing passes through the current converters along their entire length with respect to the longitudinal direction of the respective connecting lead.

3 Claims, 1 Drawing Sheet

HIGH-VOLTAGE CIRCUIT BREAKER HAVING AN INTERRUPTER MODULE

FIELD OF THE INVENTION

The present invention relates to a high-voltage power circuit breaker that has an interrupter module arranged in a first part of a grounded enclosure made of a conducting material, at least one bushing made of an insulation material connected to a mounting flange of the enclosure for the passage of electric connecting lines from the interrupter module, and at least one current converter surrounding a connecting lead in a ring shape. The current converter is mounted in the area of at least one first mounting flange of the enclosure.

BACKGROUND INFORMATION

A high voltage circuit breaker is described, for example, in U.S. Pat. No. 5,478,980. In particular, a dead tank switch having three interrupter modules, each arranged in a grounded metal enclosure and their connecting leads each guided to an overhead line connection through a bushing made of insulation material, is described. A pipe connection is provided on the metal part of each enclosure, with a mounting flange that is provided with a bushing on the end of the pipe connection.

A current converter is mounted on each pipe connection and surrounds part of the pipe connection, the mounting flange, and part of the bushing.

SUMMARY OF THE INVENTION

An object of the present invention is to create a high voltage circuit breaker, having a simpler and less expensive design, with the construction of the enclosure in particular being simplified.

This object is achieved according to the present invention by arranging the first mounting flange in the immediate vicinity of the first part of the enclosure, and by having one of the bushings pass through the entire length of the current converter in the axial direction of the connecting lead.

Due to the fact that the mounting flange is arranged in the immediate vicinity of the first part of the enclosure, it is possible for the corresponding pipe connection, which is connected to the first part of the enclosure and has the mounting flange, to be very short. The first part of the enclosure surrounding the interrupter module can thus be cast much more easily, in particular when manufactured as a cast part, and it is also simpler to subsequently machine than a part having a longer pipe connection.

Both the manufacture and the machining of the enclosure parts are therefore less expensive in all stages of value creation. The first parts of the enclosure can be shipped and stored in a space-saving manner.

An advantageous embodiment of the present invention provides for the bushing to have a flat surface, at least in the area where it passes through the current converter, or for it to have a reduced surface at the level of the umbrella.

Such a design of the bushing simplifies assembly while also greatly reducing the cost of the current converter in particular.

Another advantageous embodiment of the present invention provides for mounting the current converter on the mounting flange.

Such a mounting permits preassembly and also considerably reduces the mechanical stress on the bushing.

DETAILED DESCRIPTION

Figure 1:
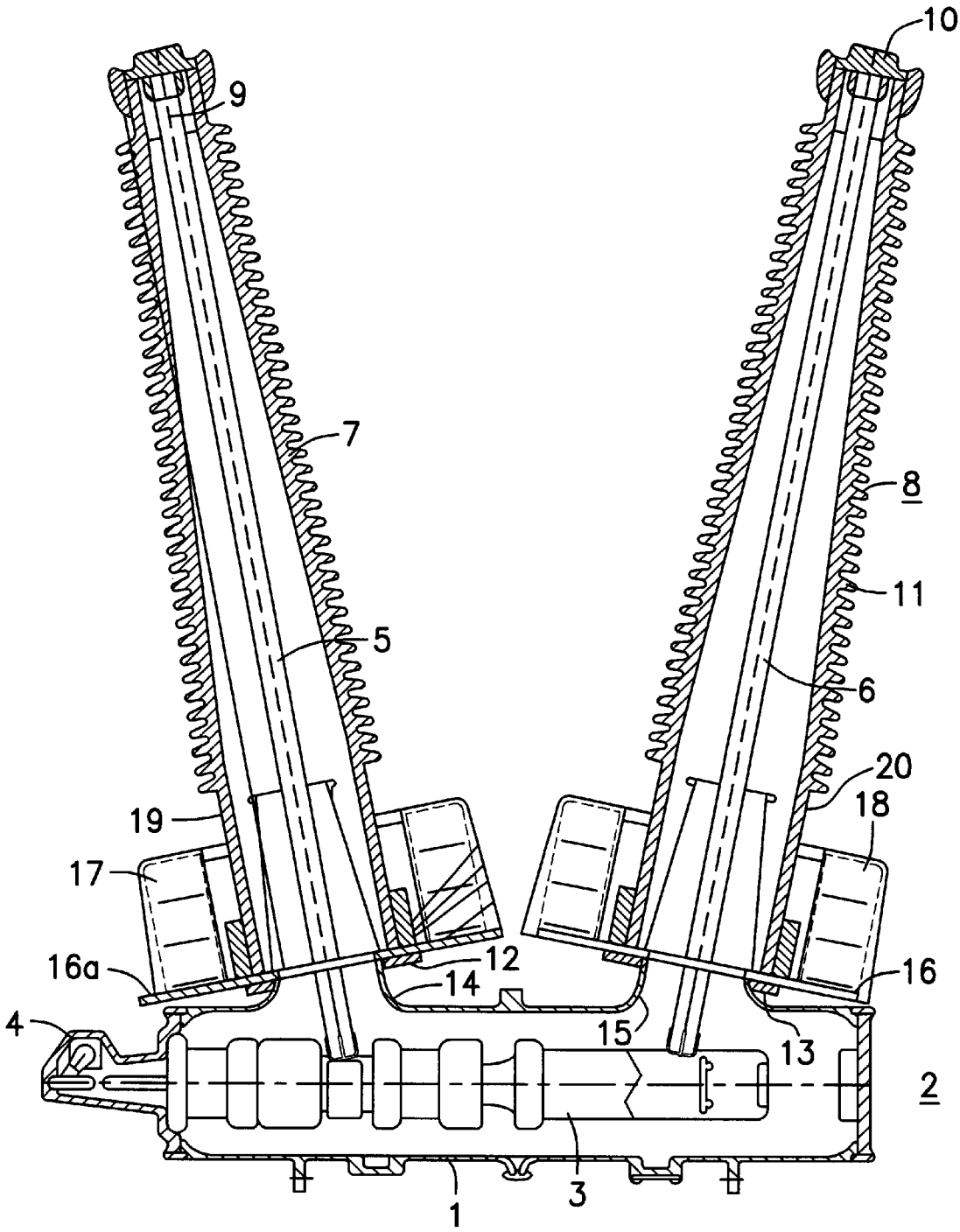
FIG. 1 shows a longitudinal section of a high voltage circuit breaker according to the present invention.

FIG. 1 shows schematically a longitudinal section through a high voltage circuit breaker having an interrupter module and two bushings.

An interrupter module 3 arranged in a first part 1 of an enclosure 2 can be driven by a drive 4 to execute a switching motion. Connecting leads 5, 6 connected to both ends of interrupter module 3 pass through bushings 7, 8 to one overhead connection 9, 10 each. Bushings 7, 8 each have a porcelain body or a composite plastic insulator. Bushings 7, 8 are provided with circumferential umbrellas 11 along most of their length.

Each bushing 7, 8 is mounted on a mounting flange 12, 13, each of which in turn being mounted on a connector 14, 15. Mounting flange 12, 13 may be molded on respective connector 14, 15, for example, or designed with an electrically conductive connection to the metal part of the enclosure.

In addition, a bearing ring 16, 16*a* is provided on each mounting flange 12, 13, with a current converter 17, 18 in the form of a toroidal core current converter sitting on it. Current converters 17, 18 each surround a connecting line 5, 6 and its enclosing porcelain body of composite insulation body.

The lower area of the respective bushing 7, 8 facing mounting flange 12, 13 is designed as insulation body 19, 20 with a cylindrical outer wall without umbrellas, the goal being to permit an inexpensive design of the current converter by reducing the diameter.

With the high voltage circuit breaker described here, pipe connectors 14, 15 can be designed to be very short, thus simplifying the manufacture of the enclosure using the casting technique, while also simplifying finishing using machine tools in comparison with an enclosure with longer pipe connectors, because the device need not be as large to accommodate the machining tool in the machine.

Use of suitably lengthened insulators as bushing insulators 7, has proven to be less expensive than manufacturing an enclosure with pipe connections 14, 15 designed to be longer instead.

What is claimed is:

1. A high-voltage circuit breaker, comprising:

a grounded enclosure made of an electrically conducting material;

an interrupter module arranged in a first part of the grounded enclosure;

at least one bushing made of an insulation material and attached to a mounting flange of the enclosure, the at least one bushing providing a passage for an electric connecting lead of the interrupter module; and at least one current converter annularly surrounding the electric connecting lead of the interrupter module and being mounted in an area of a first mounting flange of the grounded enclosure, one of the at least one bushing passing through the at least one current converter along an entire length of the at least one current converter in an axial direction of the corresponding connecting lead, the first mounting flange being arranged in an immediate vicinity of the first part of the grounded enclosure.

2. The high-voltage circuit breaker according to claim 1, wherein at least in the area where the one of the at least one bushing passes through the at least one current converter the one of at least one bushing has one of a flat surface and a reduced diameter.

3. The high-voltage circuit breaker according to claim 1, wherein the at least one current converter is mounted on the first mounting flange.

* * * * *